United States Patent [19]

Birchfield

[11] Patent Number: 5,047,753

[45] Date of Patent: Sep. 10, 1991

[54] DRAIN PLUG POSITION INDICATOR APPARATUS

[76] Inventor: David B. Birchfield, 1205 E. 55th St., Odessa, Tex. 79762

[21] Appl. No.: 529,561

[22] Filed: May 29, 1990

[51] Int. Cl.[5] ..... G08B 21/00

[52] U.S. Cl. ..... 340/686; 114/197; 200/61.42

[58] Field of Search ..... 340/686, 687, 610, 611, 340/568; 116/112, 266, 267, 273; 200/82 R, 82 C, 82 E, 61.42; 114/197

[56] References Cited

U.S. PATENT DOCUMENTS

| | | | |
|---|---|---|---|
| 2,209,466 | 7/1940 | Miller | 340/686 |
| 3,018,751 | 1/1962 | Spurlock | 114/197 |
| 3,036,541 | 5/1962 | Musick et al. | 114/197 |
| 4,542,373 | 9/1985 | Hillock | 340/686 |
| 4,843,376 | 6/1989 | Wagner et al. | 340/568 |

*Primary Examiner*—Joseph A. Orsino
*Assistant Examiner*—Jill Jackson
*Attorney, Agent, or Firm*—Leon Gilden

[57] ABSTRACT

An apparatus including a plug detector mechanism mounted adjacent an interior surface of a drain plug aperture directed through a transom of a boat. The detecting means includes a spring-biased switch positionable from an extended position in the absence of a plug to a retracted position in the presence of a plug directed through the transom. The switch is cooperative with an audible member to effect alarm in the absence of the plug.

6 Claims, 4 Drawing Sheets

PRIOR ART

DRAIN PLUG POSITION INDICATOR APPARATUS

BACKGROUND OF THE INVENTION

1. Field of the Invention

The field of invention relates to detector apparatus, and more particularly pertains to a new and improved drain plug warning apparatus for directing an alarm in the absence of a plug mounted through the transom of an associated boat.

2. Description of the Prior Art

In the construction of boats, a drain plug aperture is mounted through the rear of a transom adjacent a floor of the boat for draining of boats in a stored orientation. In utilization of the boats, it is necessary to reinstall a drain plug to prevent flooding of the boat. Inadvertently, drain plugs are at times not reinstalled and flooding is thereby created. The prior art has attempted to provide apparatus for positioning, and in some cases warning, of the absence of the aforenoted drain plug. For example, U.S. Pat. No. 4,542,373 to Hillock sets forth a switch with a chain mounted to a drain plug mounted to an interior surface of the transom, whereupon retraction of the switch in the absence of the drain plug effects an alarm.

U.S. Pat. No. 3,036,541 to Musick utilizes a solenoid including a lever mechanism to direct a drain plug within the drain aperture of an associated boat.

U.S. Pat. No. 3,993,016 to Pulaski illustrates the use of a protective enclosure for the lower drive unit of a marine engine.

U.S. Pat. No. 2,909,144 to Baldwin is illustrative of a drain plug type arrangement in cooperation with a bailer mechanism for use with a boat.

U.S. Pat. No. 3,018,751 to Spurlock sets forth an electrical bail device cooperative with a drain plug opening of a boat to effect bailing of the boat.

As such, it may be appreciated that there continues to be a need for a new and improved drain plug warning apparatus to direct attention to the absence of a drain plug within a drain plug aperture within a boat and in this respect, the present invention substantially fulfills this need.

SUMMARY OF THE INVENTION

In view of the foregoing disadvantages inherent in the known types of drain plug apparatus now present in the prior art, the present invention provides a drain plug warning apparatus wherein the same provides instant indication of absence of a drain plug within a boat transom. As such, the general purpose of the present invention, which will be described subsequently in greater detail, is to provide a new and improved drain plug warning apparatus which has all the advantages of the prior art drain plug warning apparatus and none of the disadvantages.

To attain this, the present invention provides an apparatus including a plug detector mechanism mounted adjacent an interior surface of a drain plug aperture directed through a transom of a boat. The detecting means includes a spring-biased switch positionable from an extended postion in the absence of a plug to a retracted position in the presence of a plug directed through the transom. The switch is cooperative with an audible member to effect alarm in the absence of the plug.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drain plug warning apparatus which has all the advantages of the prior art drain plug warning apparatus and none of the disadvantages.

It is another object of the present invention to provide a new and improved drain plug warning apparatus which may be easily and efficiently manufactured and marketed.

It is a further object of the present invention to provide a new and improved drain plug warning apparatus which is of a durable and reliable construction.

An even further object of the present invention is to provide a new and improved drain plug warning apparatus which is susceptible of a low cost of manufacture with regard to both materials and labor, and which accordingly is then susceptible of low prices of sale to the consuming public, thereby making such drain plug warning apparatus economically available to the buying public.

Still yet another object of the present invention is to provide a new and improved drain plug warning apparatus which provides in the apparatuses and methods of the prior art some of the advantages thereof, while simultaneously overcoming some of the disadvantages normally associated therewith.

Still another object of the present invention is to provide a new and improved drain plug warning apparatus wherein the same provides a sensor including a forward end reciprocatable in the presence of a drain plug and directed to an extended position in the absence of the aforenoted drain plug.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
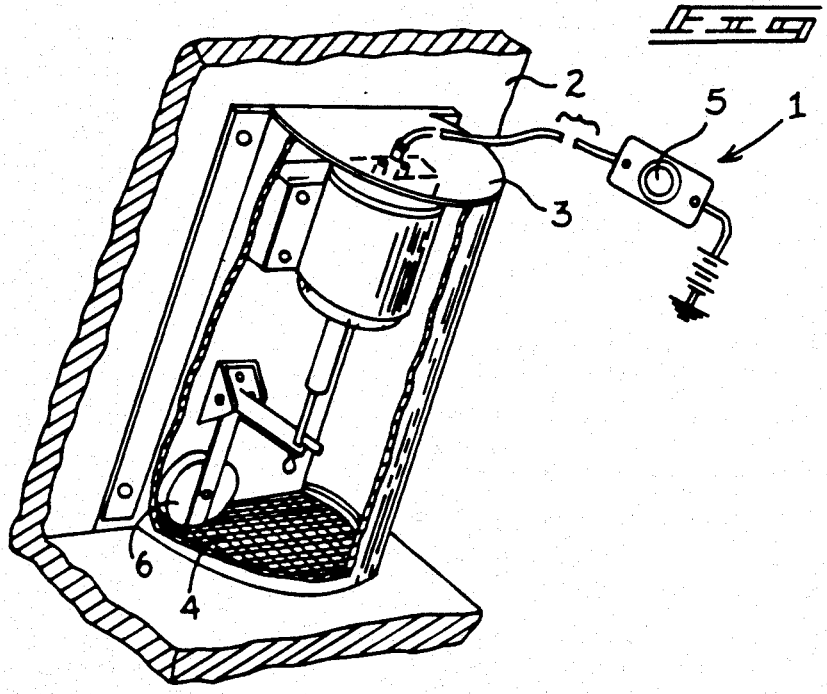
FIG. 1 is an isometric illustration of a prior art drain plug mechanism.

With reference now to the drawings, and in particular to FIGS. 1 to 8 thereof, a new and improved drain plug warning apparatus embodying the principles and concepts of the present invention and generally designated by the reference numeral 10 will be described.

Figure 2:
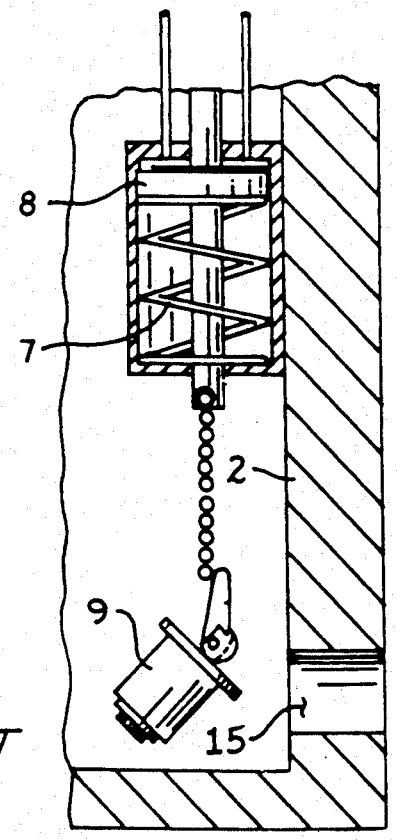
PRIOR ART Fig 2
FIG. 2 is an orthographic side view taken in elevation of a drain plug warning apparatus of the prior art.
Figure 3:
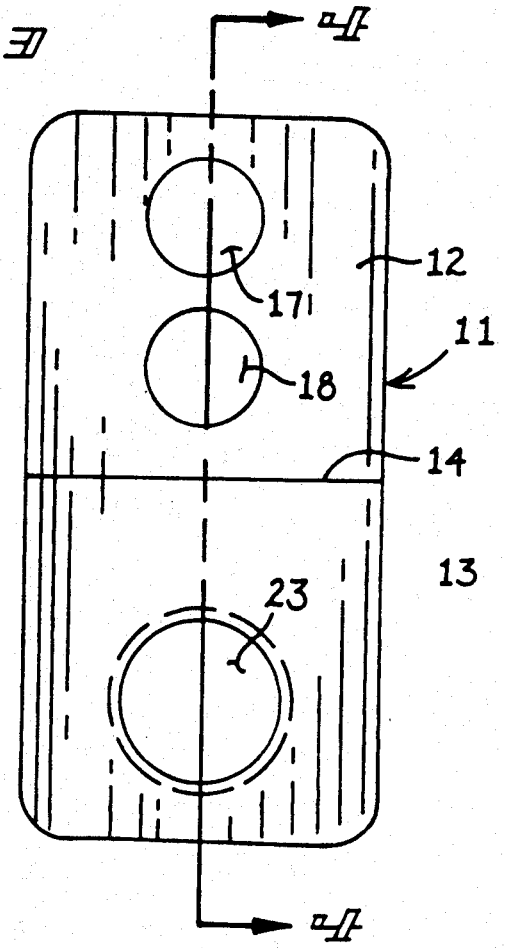
FIG. 3 is an orthographic frontal view taken in elevation of a support member utilized by the instant invention.

FIG. 1 illustrates a prior art drain plug mechanism 1 wherein a transom 2 includes a housing 3 secured thereto, with a screen member formed through a bottom surface of the housing, wherein a switch 5 selectively actuates a plug 6 to fit within a drain plug aperture of the associated transom 2. FIG. 2 illustrates a further prior art warning system wherein the transom 2 includes a switch including a coil spring 7 to normally bias a contact member 8 to a retracted position to effect electrical communication of associated wires to indicate alarm in the absence of the drain plug 9 within the associated drain plug aperture 15.

Figure 4:
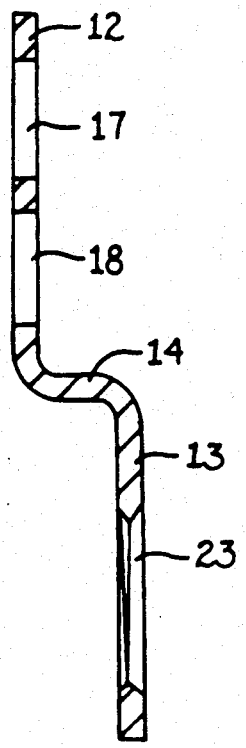
FIG. 4 is an orthographic side view taken in elevation of the support member of the instant invention.

More specifically, the drain plug warning apparatus 10 of the instant invention essentially comprises a generally "S" shaped support plate 11 defined by an upper planar web 12 spaced parallel to and offset a lower planar web 13, including a transverse web 14 integrally affixed to a lower terminal end of the upper web 12 and an upper terminal end of the lower planar web 13, and orthogonally oriented relative to the upper and lower planar webs, as illustrated in FIG. 4 for example.

Figure 5:
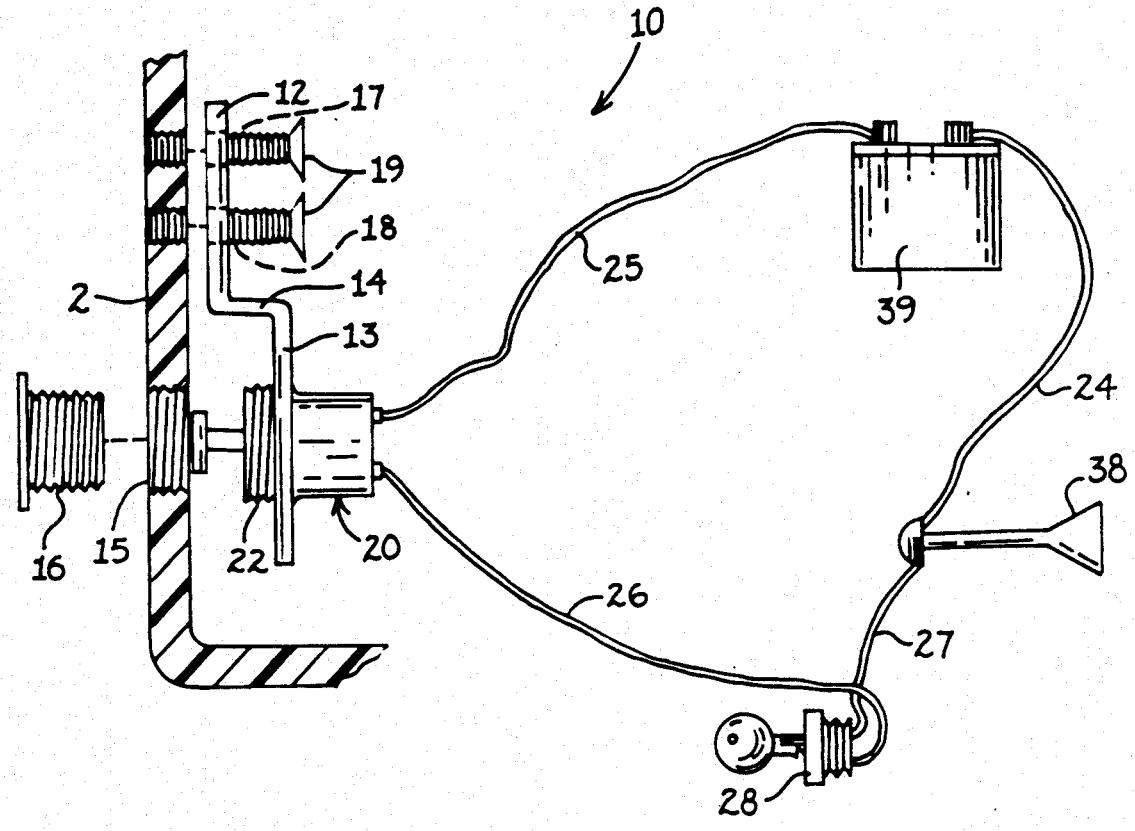
FIG. 5 is an orthographic view of the instant invention, its components, and their relationship.

Reference to FIG. 5 illustrates the invention in association with a transom 2 of a boat, with the transom including a drain plug aperture 15 directed orthogonally through a vertical wall of the transom spaced adjacent a floor of the transom, as illustrated in FIG. 5. A drain plug 16 is selectively received through the transom 15. While the transom illustrates a drain plug aperture and drain plug, various interconnections may be utilized. A respective first and second mounting aperture 17 and 18 is orthogonally directed medially of a longitudinal axis defined by the support plate 11 and directed through the upper web 12. Accordingly, a threaded mounting bore 23 is orthogonally directed through the lower web 13 underlying and aligned with the first and second mounting apertures 17 and 18. Reference to FIG. 5 illustrates the use of a plurality of fasteners 19 that are directed through the first and second mounting apertures 17 and 18 to secure the upper web 12 in contiguous contact with an interior surface of the transom 2. A switch 20 is mounted through the threaded mounting bore 23, wherein a threaded forward end 22 of the housing 21 is threadedly received within the threaded mounting bore 23, as illustrated in FIGS. 5, 6, 7, and 8. The switch 20 is mounted in electrical communication with an associated security switch 28, a horn 38, and a battery 39. A first electrical transmission line 24 associates a negative terminal of the battery 39 with the horn 38, with a second electrical transmission line 25 interconnecting the positive terminal of the battery 39 with the switch 20. A third electrical transmission line 26 electrically associates the switch 20 with the security switch 28, while a fourth transmission line 27 completes the circuit between the security switch 28 and the horn 38.

Normally, the switch 28 completes a circuit between the third and fourth electrical transmission lines 26 and 27 respectively. At times, however, an individual may wish to discontinue the circuit and open the switch 28.

Figure 6:
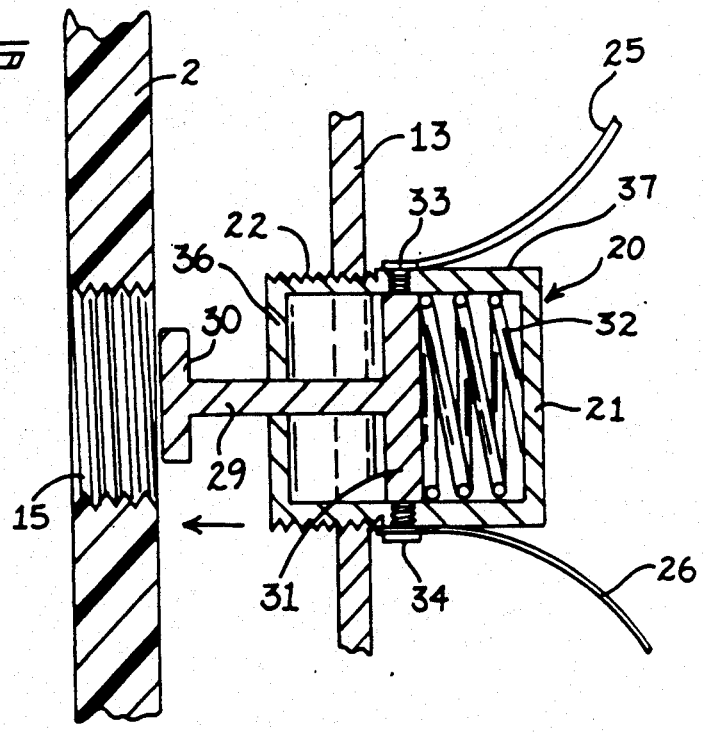
FIG. 6 is an orthographic cross-sectional view of the switch member utilized by the instant invention.
Figure 7:
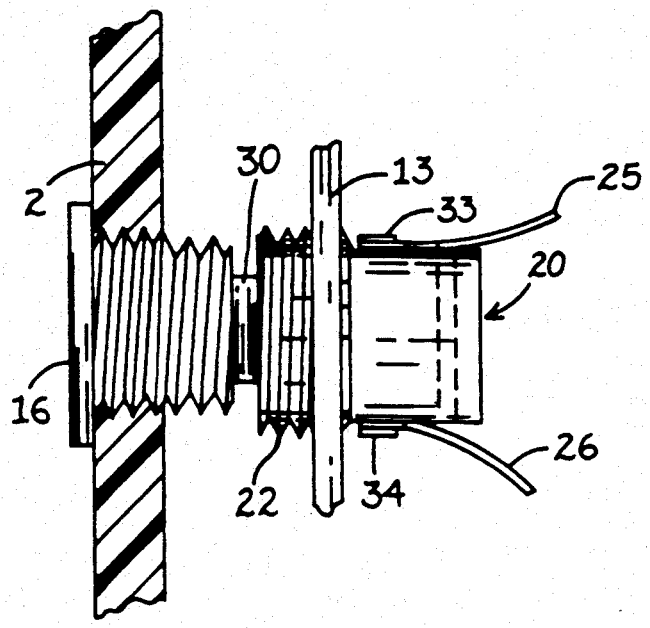
FIG. 7 is an orthographic side view taken in elevation of the switch member in a retracted first position.
Figure 8:
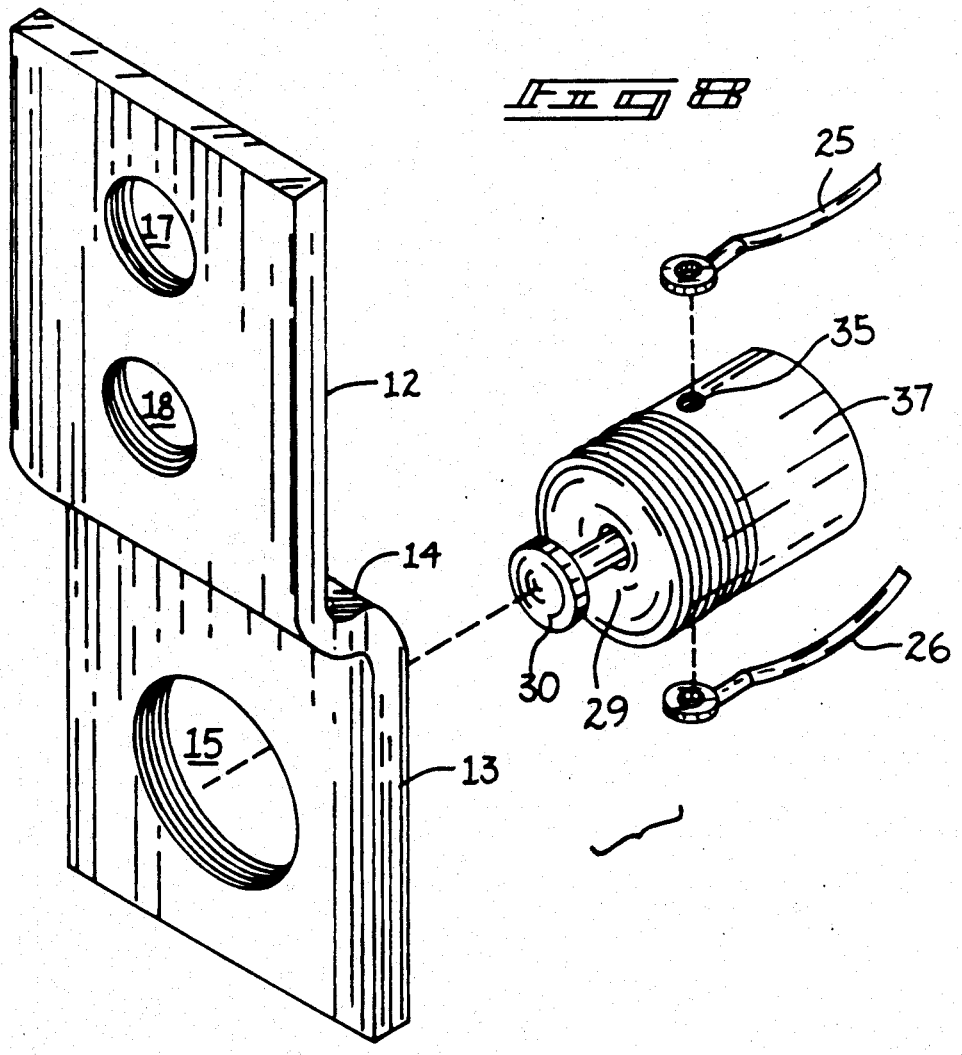
FIG. 8 is an isometric illustration, somewhat exploded, of various components of the instant invention, their configuration, and relationship.

The switch 20 includes a reciprocatably mounted plunger 29, including a forward web 30 and a rear web 31 parallel relative to one another and intercommunicated by the central plunger 31. The rear web 31 is defined by a diameter substantially equal to an internal diameter of the housing 21, with a spring member 32 captured between a rear wall of the housing 21 and a surface of the rear web 31. FIG. 6 illustrates the forward web 30 in a forward second position that simultaneously aligns the rear web 31 with a first and second respective electrical contact 33 and 34 directed through the annular side wall 37 of the housing 21. The first and second electrical contacts are directed through the housing 21 and are radially displaced relative to one another. Accordingly, the rear web 31 is formed of an electrical communicative material to complete a circuit between the first and second electrical contacts 33 and 34 to actuate the audible horn alarm 33 when in the second forward postion, as illustrated in FIG. 6. The first and second electrical contacts 33 and 34 are threadedly received within threaded contact receiving bores 35 (see FIG. 8). FIG. 7 illustrates the forward web 30 in a retracted first position, with the associated drain plug 16 in position within the associated drain plug aperture. It should also be noted that in the extended second position, the forward surface of the forward web 30 is in substantial alignment with the interior surface of the transom 2. This positioning in alignment with the rear surface of the transom 2, or extending somewhat interiorly of the drain plug aperture 15, is required in order for the forward web 30 to be in appropriate position to sense the absence of presence of the associated drain plug 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drain plug warning apparatus in combination with a boat transom, the boat transom including a vertical wall including a rear vertical wall interior surface, and a drain plug aperture positioned therethrough positioned adjacent a floor interior surface of a floor associated with a boat, wherein the apparatus comprises:

a support plate mounted to the rear vertical wall interior surface of the transom, wherein the support plate includes a first switch, the first switch including a housing and a reciprocating member mounted in the housing wherein the reciprocating member is in a forward second position extended from the housing in the absence of drain plug and in a retracted first position directed interiorly of the housing in the presence of the drain plug directed through the drain plug aperture;

an alarm member in electrical communication with the first switch;

a battery in electrical communication with the first switch and the alarm member wherein the alarm member is actuated upon the reciprocating member extended to the forward second position; and the support plate including an upper planar web parallel to a lower planar web, with a transverse web orthogonally oriented between the upper planar web and the lower planar web, wherein the transverse web is integrally secured to a lower terminal edge of the upper planar web and to an upper terminal edge of the lower planar web, and the lower planar web includes a threaded aperture threadedly receiving the first switch, and the first switch including a threaded forward end, the threaded forward end reciprocatably received within the threaded aperture to permit adjustment of the first switch relative to the lower planar web.

2. An apparatus as set forth in claim 1 wherein the upper planar web includes a first and second mounting aperture, and further including first and second fasteners directed through the first and second mounting apertures fixedly mounting the upper planar web in contiguous contact with the interior surface of the transom.

3. An apparatus as set forth in claim 2 further including a second switch, and a first electrical transmission line connecting the battery to the first switch, and a second electrical transmission line connecting the first switch to the second switch, and a third electrical transmission line connecting the second switch to the alarm member, and a fourth electrical transmission line connecting the alarm member to the battery, the second switch selectively positionable to an opened or closed position to effectively electrically engage or electrically disengage the alarm member.

4. An apparatus as set forth in claim 2 wherein the housing includes a cylindrical housing, the cylindrical housing including a central cavity therewithin, and the reciprocating member including a first web positioned exteriorly of the housing and a second web mounted interiorly of the housing, and a plunger intercommunicating the first web and the second web, and the second web defined by a predetermined diameter substantially equal to an internal diameter defined by the cavity of the housing.

5. An apparatus as set forth in claim 4 including a spring member captured between a rear face of the second web and an interior surface of the housing to normally bias the second web in the forward second position.

6. An apparatus as set forth in claim 5 wherein the second web is formed of an electrically communicative material.

* * * * *